US008490317B2

(12) United States Patent
Adkins et al.

(10) Patent No.: US 8,490,317 B2
(45) Date of Patent: Jul. 23, 2013

(54) LOCKING TURRET

(75) Inventors: Joseph R. Adkins, Howell, MI (US); Thomas K. Maciak, Brighton, MI (US)

(73) Assignee: Trijicon, Inc., Wixom, MI (US)

( * ) Notice: Subject to any disclaimer, the term of this patent is extended or adjusted under 35 U.S.C. 154(b) by 35 days.

(21) Appl. No.: 13/331,617

(22) Filed: Dec. 20, 2011

(65) Prior Publication Data

US 2012/0167444 A1 Jul. 5, 2012

Related U.S. Application Data

(60) Provisional application No. 61/428,518, filed on Dec. 30, 2010.

(51) Int. Cl.
*F41G 1/00* (2006.01)
*F41G 1/38* (2006.01)

(52) U.S. Cl.
USPC ..... 42/135

(58) Field of Classification Search
USPC ..... 42/119, 122, 135, 136, 137, 138, 42/139; 74/553
See application file for complete search history.

(56) References Cited

U.S. PATENT DOCUMENTS

| | | | | |
|---|---|---|---|---|
| 3,990,155 | A * | 11/1976 | Akin et al. | 42/122 |
| 4,247,161 | A * | 1/1981 | Unertl, Jr. | 359/424 |
| 4,373,269 | A * | 2/1983 | Doliber et al. | 42/122 |
| 5,513,440 | A * | 5/1996 | Murg | 42/122 |
| 6,643,970 | B2 | 11/2003 | Huber | |
| 6,762,884 | B2 | 7/2004 | Beystrum et al. | |
| 6,772,550 | B1 * | 8/2004 | Leatherwood | 42/119 |
| 7,415,791 | B2 | 8/2008 | Williams, III et al. | |
| 7,483,213 | B2 | 1/2009 | Pochapsky | |
| 7,612,952 | B2 | 11/2009 | Schafer | |
| 7,913,440 | B2 | 3/2011 | Murg et al. | |
| 8,006,429 | B2 | 8/2011 | Windauer | |
| 8,166,696 | B2 | 5/2012 | Hamilton | |
| 8,312,667 | B2 | 11/2012 | Thomas et al. | |
| 8,397,420 | B2 | 3/2013 | Hamilton | |
| 2003/0140545 | A1 * | 7/2003 | Huber | 42/122 |
| 2007/0137089 | A1 * | 6/2007 | William et al. | 42/122 |
| 2007/0240356 | A1 * | 10/2007 | Klepp et al. | 42/122 |
| 2008/0236018 | A1 | 10/2008 | Halverson | |
| 2009/0044660 | A1 * | 2/2009 | Bonis | 74/813 L |
| 2009/0199452 | A1 * | 8/2009 | Huber | 42/125 |
| 2009/0205461 | A1 | 8/2009 | Windauer | |
| 2010/0175298 | A1 | 7/2010 | Thomas et al. | |
| 2011/0061285 | A1 * | 3/2011 | Hamilton | 42/122 |
| 2011/0102918 | A1 * | 5/2011 | Windauer | 359/821 |
| 2011/0242650 | A1 | 10/2011 | Windauer | |
| 2011/0261449 | A1 | 10/2011 | Schmitt | |

* cited by examiner

*Primary Examiner* — Bret Hayes
(74) *Attorney, Agent, or Firm* — Harness, Dickey & Pierce, P.L.C.

(57) ABSTRACT

An adjustment turret for an optical sight includes a body, an adjustment shaft, a cap, and a locking pin. The body includes a cavity and an axial bore. The adjustment shaft threadably engages the axial bore for relative rotation therebetween. The cap is connected to the adjustment shaft for rotation with the adjustment shaft relative to the body and is axially movable relative to the body and the adjustment shaft between a first position and a second position. The locking pin is axially movable with the cap and is received in the cavity when the cap is in the first position to prevent relative rotation between the cap and the body and is removed from the cavity when the cap is in the second position to allow relative rotation between the cap and the body.

28 Claims, 14 Drawing Sheets

LOCKING TURRET

CROSS-REFERENCE TO RELATED APPLICATIONS

This application claims the benefit of U.S. Provisional Application No. 61/428,518, filed on Dec. 30, 2010. The disclosure of the above application is incorporated herein by reference in its entirety.

FIELD

The present disclosure relates to an optical sight and more particularly to an optical sight for a firearm having a locking adjustment turret.

BACKGROUND

This section provides background information related to the present disclosure and is not necessarily prior art.

Optical sights are commonly used with firearms such as rifles and/or handguns to allow a user to more clearly see a target and aim the firearm at the target. Conventional optical sights include a series of lenses and/or other optical components that magnify an image and provide a reticle to allow a user to align a magnified target relative to a barrel of the firearm. Optical sights may include one or more adjustment mechanisms that allow for adjustment of a position of the reticle relative to the barrel of the firearm to properly "zero" the optical sight to the firearm and/or to account for environmental conditions such as, for example, wind.

SUMMARY

This section provides a general summary of the disclosure, and is not a comprehensive disclosure of its full scope or all of its features.

The present disclosure provides an adjustment turret for an optical sight. The adjustment turret may include a body, an adjustment shaft, a cap, and a locking pin. The body may include a cavity and an axial bore extending therethrough. The adjustment shaft may threadably engage the axial bore for relative rotation therebetween. The cap may be connected to the adjustment shaft for rotation with the adjustment shaft relative to the body and at least partially receiving the adjustment shaft. The cap may be axially movable relative to the body and the adjustment shaft between a first position and a second position. The locking pin may be axially movable with the cap when the cap is moved between the first position and the second position. The locking pin may be received in the cavity when the cap is in the first position to prevent relative rotation between the cap and the body and may be removed from the cavity when the cap is in the second position to allow relative rotation between the cap and the body.

The present disclosure also provides an adjustment turret that may include a body, and adjustment shaft, a cap and a stop ring. The body may include a first stop tab and an axial bore extending through the body. The adjustment shaft may threadably engage the axial bore for relative rotation therebetween. The cap may be connected to the adjustment shaft for rotation with the adjustment shaft relative to the body. The stop ring may include a second stop tab selectively interfering with the first stop tab to limit rotation of the adjustment shaft in a first direction.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
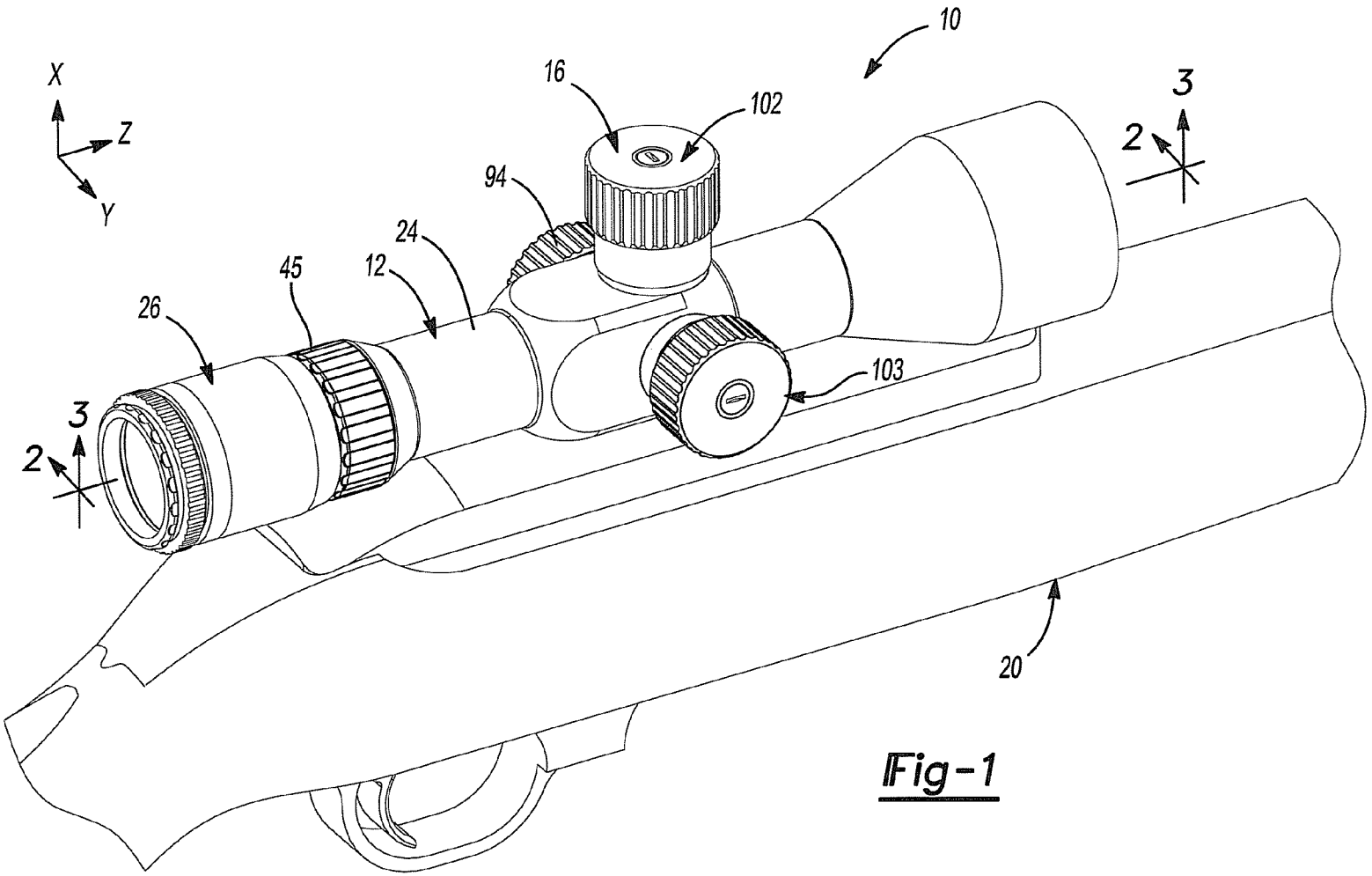
FIG. 1 is a perspective view of an optical sight according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIGS. 1-12, an optical sight 10 is provided and may include a housing 12, an optics train 14, and an adjustment system 16. The housing 12 is removably attached to a firearm 20 and supports the optics train 14 and the adjustment system 16. The optics train 14 cooperates with the housing 12 to provide a magnified image of a target while the adjustment system 16 positions at least a portion of the optics train 14 relative to the housing 12 to properly align a reticle pattern 22 (FIG. 6) relative to the firearm 20. A light-emitting diode (LED) (not shown) or other illumination system may cooperate with the optics train 14 to illuminate the reticle pattern 22 to assist a user in aligning the target relative to the optical sight 10 and the firearm 20.

The housing 12 may be removably secured to the firearm 20 and includes a main body 24 attached to an eyepiece 26. The main body 24 may be a generally tubular member including an inner cavity 30 having a longitudinal axis 32, a first end 34, a second end 36 and a tapered portion 38. The first end 34 of the main body 24 may include a threaded inner surface 39 and a threaded outer surface 40 engaging the eyepiece 26. A partially spherical first seat surface 42 may be disposed adjacent to the threaded inner surface 39. A tubular cap 43 may threadably engage the threaded inner surface 39 and may include a partially spherical second seat surface 44 that is directly adjacent to the first seat surface 42 when the tubular cap 43 is assembled within the main body 24. The first and second seat surfaces 42, 44 cooperate to form a partially spherical socket. A zoom-adjustment ring 45 may rotatably engage an outer diametrical surface of the main body 24 adjacent to the eyepiece 26. The second end 36 of the main body 24 is disposed generally on an opposite side of the main body 24 from the first end 34 and includes a generally circular cross section. The tapered portion 38 is disposed between the first end 34 and the second end 36.

The main body 24 supports the adjustment system 16 and may include a first bore 46 (FIGS. 2 and 4) and a second bore 47 (FIGS. 3 and 4) that receive portions of the adjustment system 16 therein. The first and second bores 46, 47 may include first and second threaded portions 48, 49, respectively, and first and second substantially cylindrical portions 50, 51, respectively. The first and second bores 46, 47 may be rotationally spaced apart from each other about the longitudinal axis 32 by ninety degrees (90°).

Figure 2:
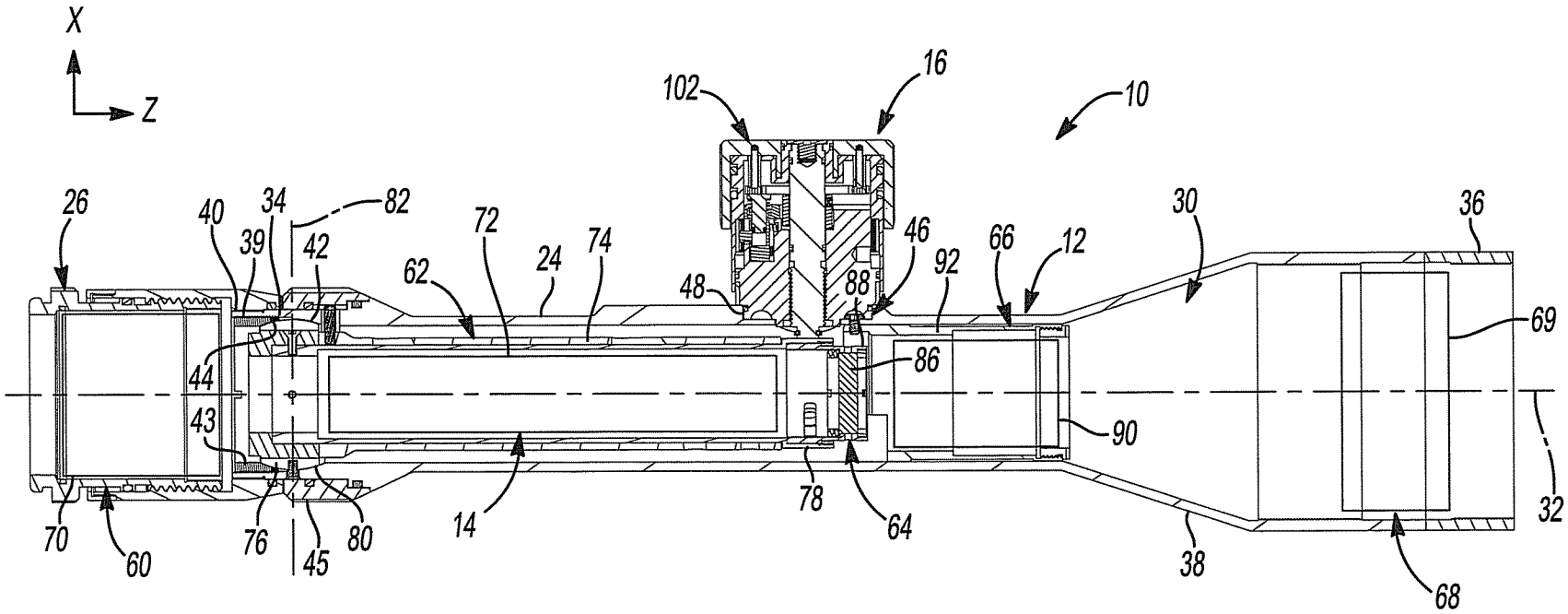
FIG. 2 is a cross-sectional view of the optical sight of FIG. 1 taken along line 2-2.
Figure 3:
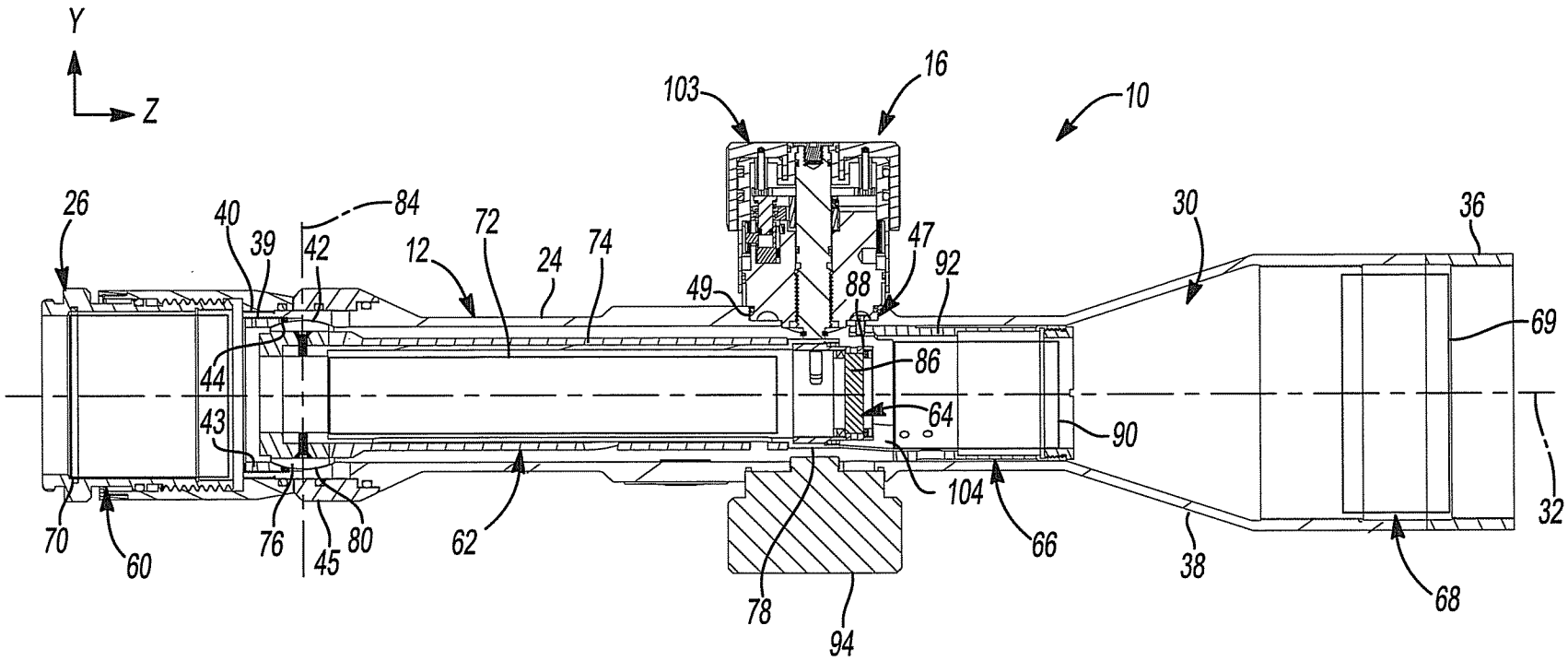
FIG. 3 is a cross-sectional view of the optical sight of FIG. 1 taken along line 3-3.
Figure 4:
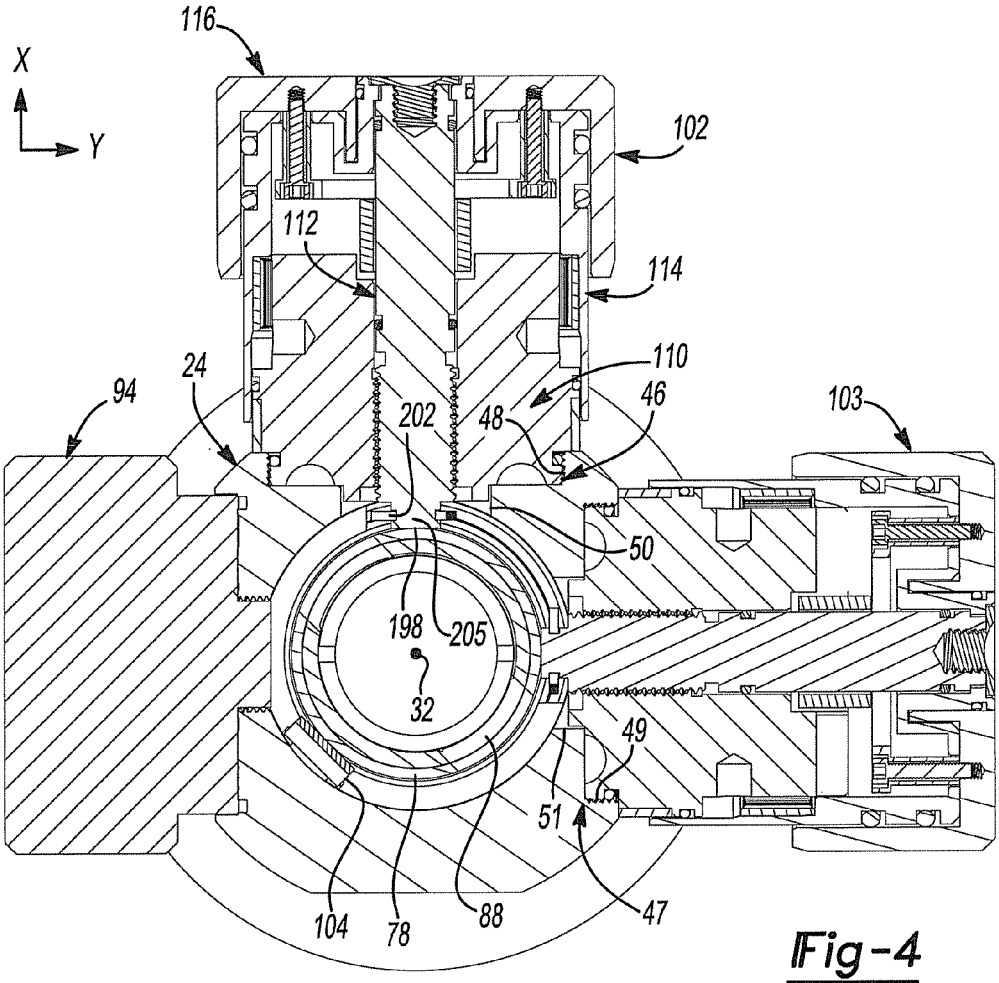
FIG. 4 is a cross-sectional view of an adjustment system of the optical sight according to the principles of the present disclosure.
Figure 6:
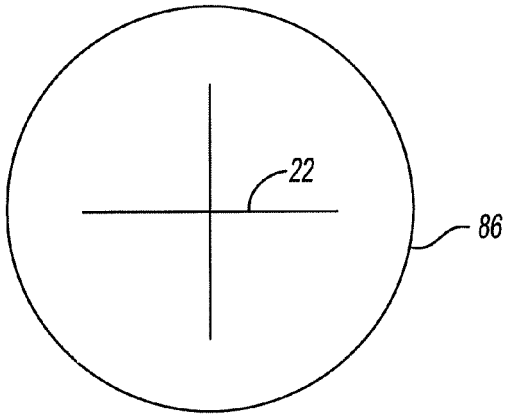
FIG. 6 is a schematic representation of a reticle pattern of the optical sight of FIG. 1.

With particular reference to FIGS. 2-4, the optics train 14 may include an ocular assembly 60, a zoom assembly 62, a reticle assembly 64, a parallax assembly 66, and an objective assembly 68. The ocular assembly 60 may include an ocular-lens assembly 70 housed in the eyepiece 26. The zoom assembly 62 may include a zoom-lens assembly 72 and a zoom-lens housing 74 supporting the zoom-lens assembly 72. A user may rotate the zoom-adjustment ring 45 to adjust a configuration or position of the zoom-lens assembly 72 relative to the housing 12. The zoom-lens housing 74 may be an elongated, generally tubular member extending generally along the longitudinal axis 32. The zoom-lens housing 74 may include a first end 76 disposed proximate the first end 34 of the main body 24 and a second end 78 disposed between the first end 76 and the tapered portion 38 of the main body 24. The first end 76 may include a partially spherical outer surface 80 that rotatably engages the partially spherical socket formed by the first and second seat surfaces 42, 44. In this manner, the zoom-lens housing 74 may be rotatably movable relative to the main body 24 about a first axis 82 (FIG. 2) and a second axis 84 (FIG. 3). The first and second axes 82, 84 are perpendicular to each other and to the longitudinal axis 32.

The reticle assembly 64 may include one or more reticle lenses 86 and a reticle-lens housing 88 supporting the one or more reticle lenses 86. The reticle lens 86 may include the reticle pattern 22 (FIG. 6) formed thereon by an etching process, black-chrome-masking process, and/or diffraction grating process, for example. The reticle-lens housing 88 may engage an inner surface of the second end 78 of the zoom-lens housing 74. Therefore, rotational movement of the zoom-lens housing 74 about the first and/or second axes 82, 84 relative to the main body 24 causes corresponding rotational movement of the reticle-lens housing 88 and the reticle pattern 22 about the first and/or second axes 82, 84 relative to the main body 24.

The parallax assembly 66 may be disposed between the reticle assembly 64 and the second end 36 of the main body 24 and may include a parallax-lens assembly 90 supported by a parallax housing 92. A parallax-adjustment knob 94 protruding from the main body 24 may adjust a configuration or position of the parallax-lens assembly 90 when rotated relative to the housing 12. Finally, the objective assembly 68 may be disposed proximate the second end 36 of the main body 24 and may include an objective-lens assembly 69.

It should be appreciated that the above description of the optics train 14 is provided to illustrate an exemplary configuration of optical components. The principles of the present disclosure are not limited in application to an optical sight having an optics train including the particular components and/or arrangement of components described above. The optical sight 10 may include any other configuration or arrangement of optical components to suit a given application and may provide the optical sight 10 with virtually any magnification.

Figure 5:
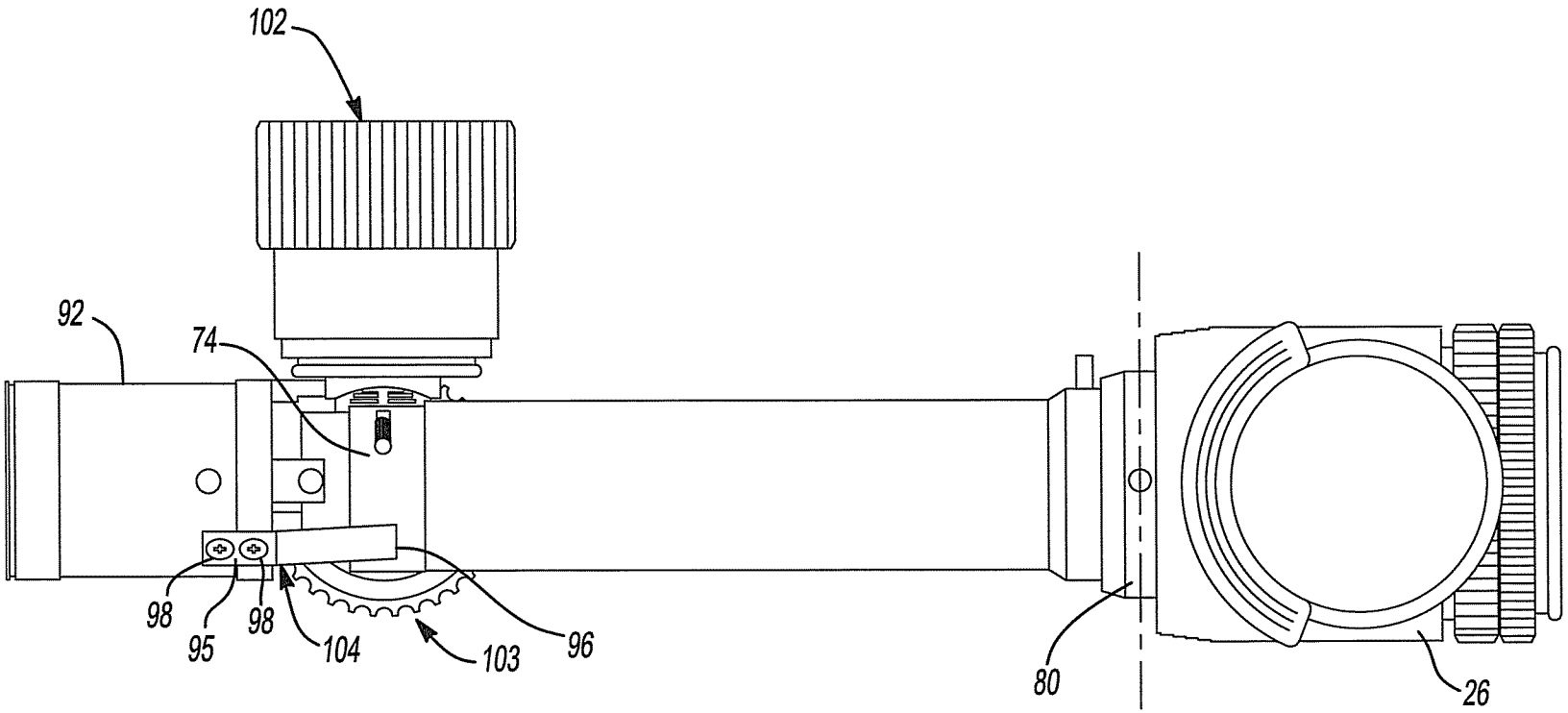
FIG. 5 is a side view of the optical sight of FIG. 1 with a portion of a housing removed.
Figure 7:
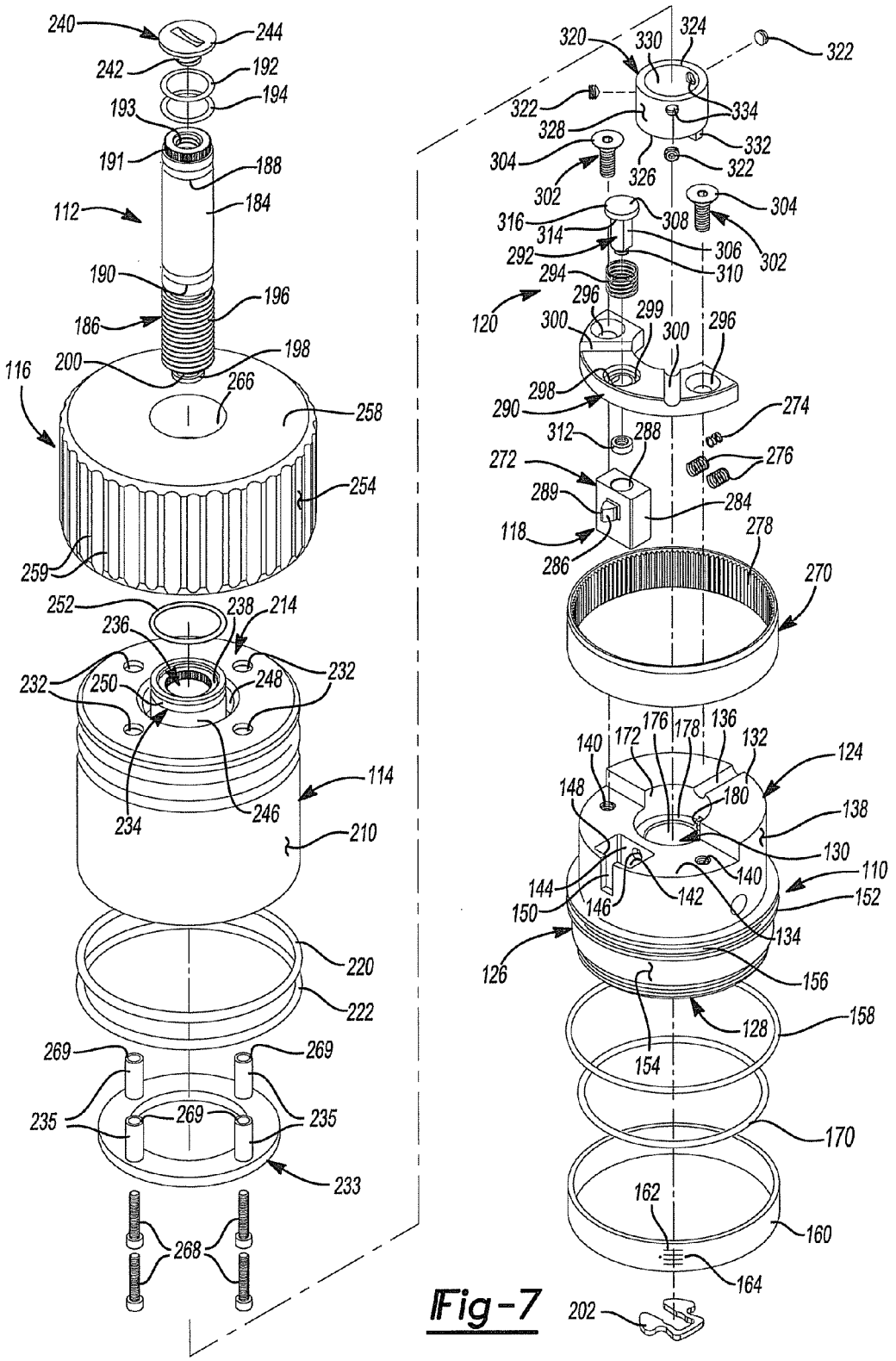
FIG. 7 is an exploded perspective view of an adjustment turret of the adjustment system of FIG. 4 according to the principles of the present disclosure.
Figure 8:
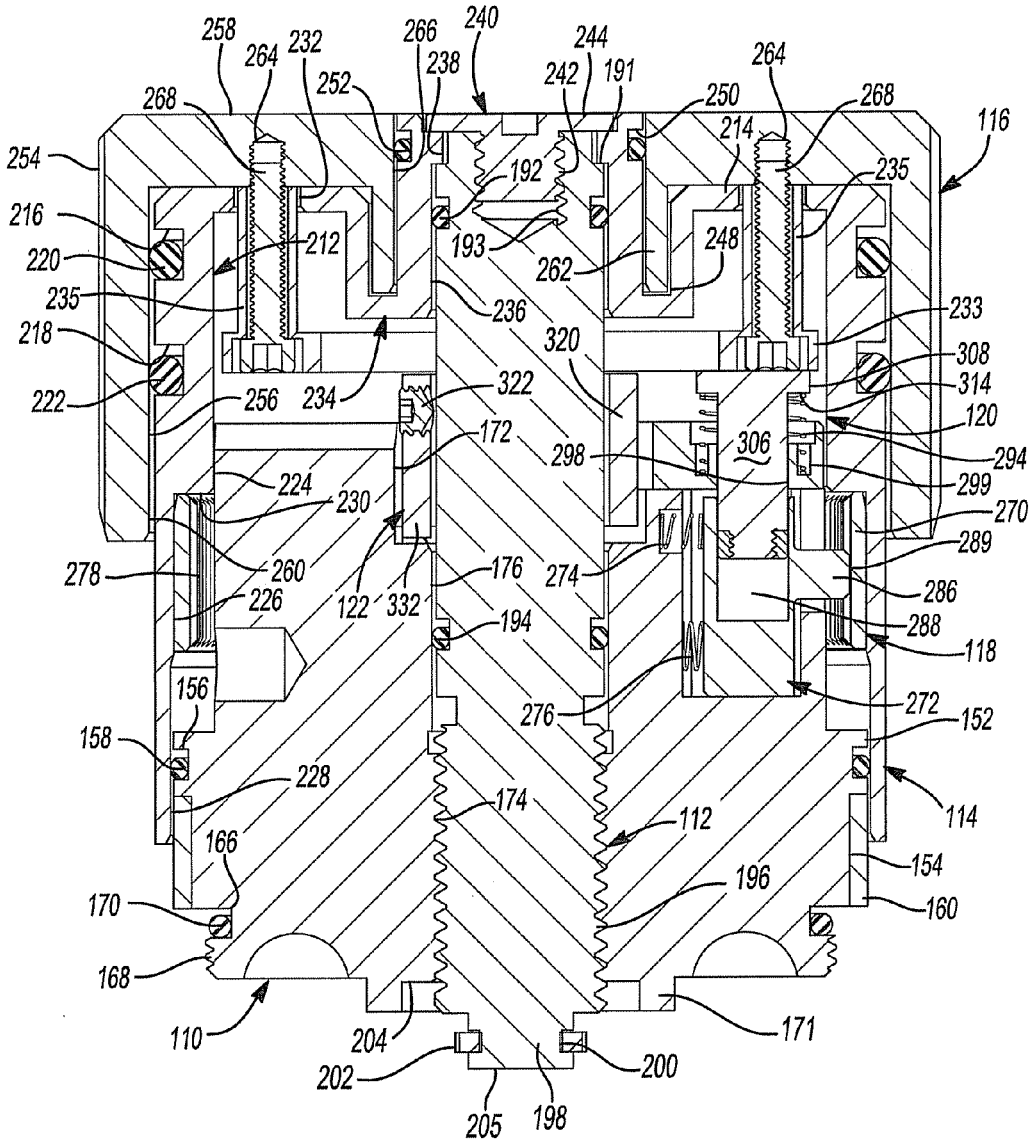
FIG. 8 is a cross-sectional view of the adjustment turret of FIG. 7 in a locked state.

Referring now to FIGS. 1-5, the adjustment system 16 may include first and second adjuster assemblies or turrets 102, 103 and a biasing member 104 (FIG. 3). The first adjuster assembly 102 may threadably engage the first bore 46 in the main body 24. The second adjuster assembly 103 may threadably engage the second bore 47 in the main body 24. The biasing member 104 may be a leaf spring, for example, or any other spring or resiliently compliant member and may be disposed within the main body 24. As shown in FIG. 4, the biasing member 104 may be rotationally spaced apart from both of the first and second adjuster assemblies 102, 103 about the longitudinal axis 32 by approximately one-hundred-thirty-five degrees (135°) to biasingly oppose both of the first and second adjuster assemblies 102, 103 substantially equally. As shown in FIG. 5, the biasing member 104 may include a first end 95 and a second end 96. Fasteners 98 may secure the first end 95 to the parallax housing 92 or the main body 24, for example. The second end 96 may biasingly contact an outer surface of the zoom-lens housing 74 and bias the zoom-lens housing 74 toward the first and second adjuster assemblies 102, 103.

The first adjuster assembly 102 may cooperate with the biasing member 104 to rotate the zoom-lens housing 74 about the second axis 84 relative to the housing 12. Likewise, the second adjuster assembly 103 may cooperate with the biasing member 104 to rotate the zoom-lens housing 74 about the first axis 82 relative to the housing 12. Movement of the zoom-lens housing 74 relative to the housing 12 similarly moves the reticle-lens housing 88 and the reticle lens 86 to adjust a position of the reticle pattern 22 relative to the housing 12. In this manner, movement of the first adjuster assembly 102 causes corresponding movement of the reticle pattern 22 relative to the housing 12 to align the reticle pattern 22 relative to the firearm 20 to account for elevation. Similarly, movement of the second adjuster assembly 103 causes corresponding movement of the reticle pattern 22 relative to the housing 12 to align the reticle pattern 22 relative to the firearm 20 to account for windage.

Referring now to FIGS. 4 and 7-12, the first adjuster assembly 102 may include a body 110, an adjustment screw 112, a sleeve 114, a cap 116, a detent mechanism 118, a locking mechanism 120, and a baseline-return mechanism 122. The body 110 may be a generally cylindrical member and may be fixed relative to the housing 12 at least partially within the first bore 46. The body 110 may include a first portion 124, a second portion 126, a third portion 128, and an axial bore 130 extending through the first, second and third portions 124, 126, 128. The first portion 124 may include a raised portion 132 and a recessed portion 134. The raised portion 132 may include an access slot or aperture 136 extending radially between the axial bore 130 and an outer diametrical surface 138 of the first portion 124. The recessed portion 134 may include a plurality of threaded apertures 140 and a cavity 142 disposed between the outer diametrical surface 138 and the axial bore 130. The cavity 142 may be generally rectangular and may include a first surface 144 having a spring seat 146 extending radially inwardly therefrom and a second surface 148 opposing the first surface 144. The second surface 148 may include a slot 150 extending through the outer diametrical surface 138.

The second portion 126 may include a first outer surface 152 and a second outer surface 154. The first outer surface 152 may be adjacent the first portion 124 and may include an annular groove 156 receiving a sealing member 158 such as, for example, an O-ring. The second outer surface 154 may include a smaller diameter than the first outer surface 152 and may engage an indicator ring 160. The indicator ring 160 may include a plurality of lines, arrows or other indicia 162 and one or more numbers 164 or other characters corresponding to the indicia 162. The indicia 162 and/or numbers 164 may cooperate to indicate a range or distance to a target and a position of the body 110 relative to the sleeve 114. The indicia 162 and/or numbers 164 may be painted, etched, scribed or otherwise formed in the indicator ring 160.

The third portion 128 may include a smaller outer diameter than the second portion 126 defined by first and second outer surfaces 152, 154 and may include an annular groove 166 and a threaded portion 168. As shown in FIG. 4, the threaded portion 168 may engage the threaded portion 48 of the first bore 46 in the main body 24 of the housing 12. A sealing member 170 such as an O-ring may be received in the annular groove 166 and may sealingly engage a portion of the first bore 46 to prevent moisture and/or debris from entering the inner cavity 30 of the housing 12 and damaging the optics train 14. A raised ring 171 may protrude downward (relative to the view shown in FIGS. 7 and 8) from an end of the third portion 128 and may engage the substantially cylindrical portion 50 of the first bore 46.

The axial bore 130 may include a recessed portion 172, a threaded portion 174, and a central portion 176 disposed between the recessed portion 172 and the threaded portion 174. The recessed portion 172 may extend at least partially through the first portion 124 and may have a larger diameter than the threaded and central portions 174, 176. The recessed portion 172 may include an annular ledge 178 disposed adjacent to the central portion 176. The annular ledge 178 may include a tab 180 protruding therefrom substantially parallel to an axis defining the axial bore 130.

The adjustment screw 112 may be an elongated shaft extending through the axial bore 130 and may include an upper portion 184 and a lower portion 186. The upper portion 184 may include first and second annular grooves 188, 190 and a recessed-end portion 191 having an axially-extending threaded bore 193. First and second sealing members 192, 194 may be received in the first and second annular grooves 188, 190, respectively. The first sealing member 192 sealingly engages the first annular groove 188 and the sleeve 114 to prevent moisture and debris from entering the first adjuster assembly 102. The second sealing member 194 sealingly engages the second annular groove 190 and the axial bore 130 to prevent moisture and debris from contacting the threaded portion 174 of the axial bore 130 or from entering the inner cavity 30 of the housing 12.

The lower portion 186 may include a threaded portion 196 and an axial protrusion 198. The threaded portion 196 may engage the threaded portion 174 of the axial bore 130 to allow the adjustment screw 112 to rotate relative to the body 110. The axial protrusion 198 may include an annular groove 200 that engages a clip 202 via a snap-fit. Movement of the adjustment screw 112 upward (relative to the views shown in FIGS. 8 and 9) past a predetermined distance away from the biasing member 104 will cause the clip 202 to abut a bottom surface 204 of the body 110. In this manner, the clip 202 prevents the adjustment screw 112 from being removed from the first adjuster assembly 102 while the first adjuster assembly 102 is installed in the housing 12. A distal end 205 of the axial protrusion 198 may abut an outer surface of the second end 78 of the zoom-lens housing 74 (FIG. 4).

The sleeve 114 may be a generally cup-shaped member having an outer diametrical surface 210, an inner diametrical surface 212, and an end portion 214. The outer diametrical surface 210 may include first and second annular grooves 216, 218 receiving first and second sealing members 220, 222, respectively. The inner diametrical surface 212 may include a first portion 224, a second portion 226, and a third portion 228. The first portion 224 may be disposed adjacent the end portion 214 and may have a diameter that is smaller than diameters of the second and third portions 226, 228. The second portion 226 may be adjacent the first portion 224 and may cooperate with the first portion 224 to define an annular recess 230. The third portion 228 may engage the second portion 126 of the body 110 for relative rotation therebetween and may sealingly engage the sealing member 158 to prevent moisture and debris from entering the first adjuster assembly 102.

The end portion 214 may include a plurality of apertures 232 and a central hub 234. A ring 233 having a plurality of integrally-formed bushings 235 may engage the end portion 214. Each of the plurality of bushings 235 may be aligned with a corresponding one of the apertures 232 and may be slidably received therein.

The central hub 234 may include an axial bore 236 that extends therethrough and has an annular rim 238. The axial bore 236 may at least partially receive the upper portion 184 of the adjustment screw 112 such that the recessed-end portion 191 of the adjustment screw 112 abuts the annular rim 238. The first sealing member 192 contacts the axial bore 236 to provide a sealed relationship between the axial bore 236 and the adjustment screw 112.

A fastener 240 may rotationally fix the adjustment screw 112 relative to the sleeve 114. A threaded shaft 242 of the fastener 240 engages the threaded bore 193 and a head portion 244 of the fastener 240 may provide a clamping force on the annular rim 238 when the fastener 240 is threadably tightened onto the adjustment screw 112. Additionally or alternatively, an outer diameter of the recessed-end portion 191 may include splines that engage splines formed in the axial bore 236. In this manner, engagement between the splines of the recessed-end portion 191 and the splines of the axial bore 236 may prevent relative rotation between the adjustment screw 112 and the sleeve 114.

An outer portion 246 of the central hub 234 may include an axially-extending annular recess 248 and an annular groove 250. The cap 116 may be at least partially received within the annular recess 248 and a sealing member 252 may be received in the annular groove 250.

The cap 116 may be a generally cup-shaped member including an outer surface 254, an inner surface 256, and an end portion 258. The outer surface 254 may include a plurality of ridges 259 and/or other features to facilitate gripping of the outer surface 254. The inner surface 256 and the end portion 258 may cooperate to define a cavity 260. The sleeve 114 may be at least partially received in the cavity 260 such that the outer diametrical surface 210 of the sleeve 114 slidably engages the inner surface 256 of the cap 116 to allow relative axial movement between the cap 116 and the sleeve 114. The first and second sealing members 220, 222 may sealingly engage the inner surface 256 to prevent moisture and debris from entering the first adjuster assembly 102 between the cap 116 and the sleeve 114.

The end portion 258 of the cap 116 may include an annular hub 262 having an axially-extending bore 266 and a plurality of threaded apertures 264. The annular hub 262 may be slidably received in the annular recess 248 of the sleeve 114. The central hub 234 of the sleeve 114 may be slidably received in the axially-extending bore 266.

Figure 9:
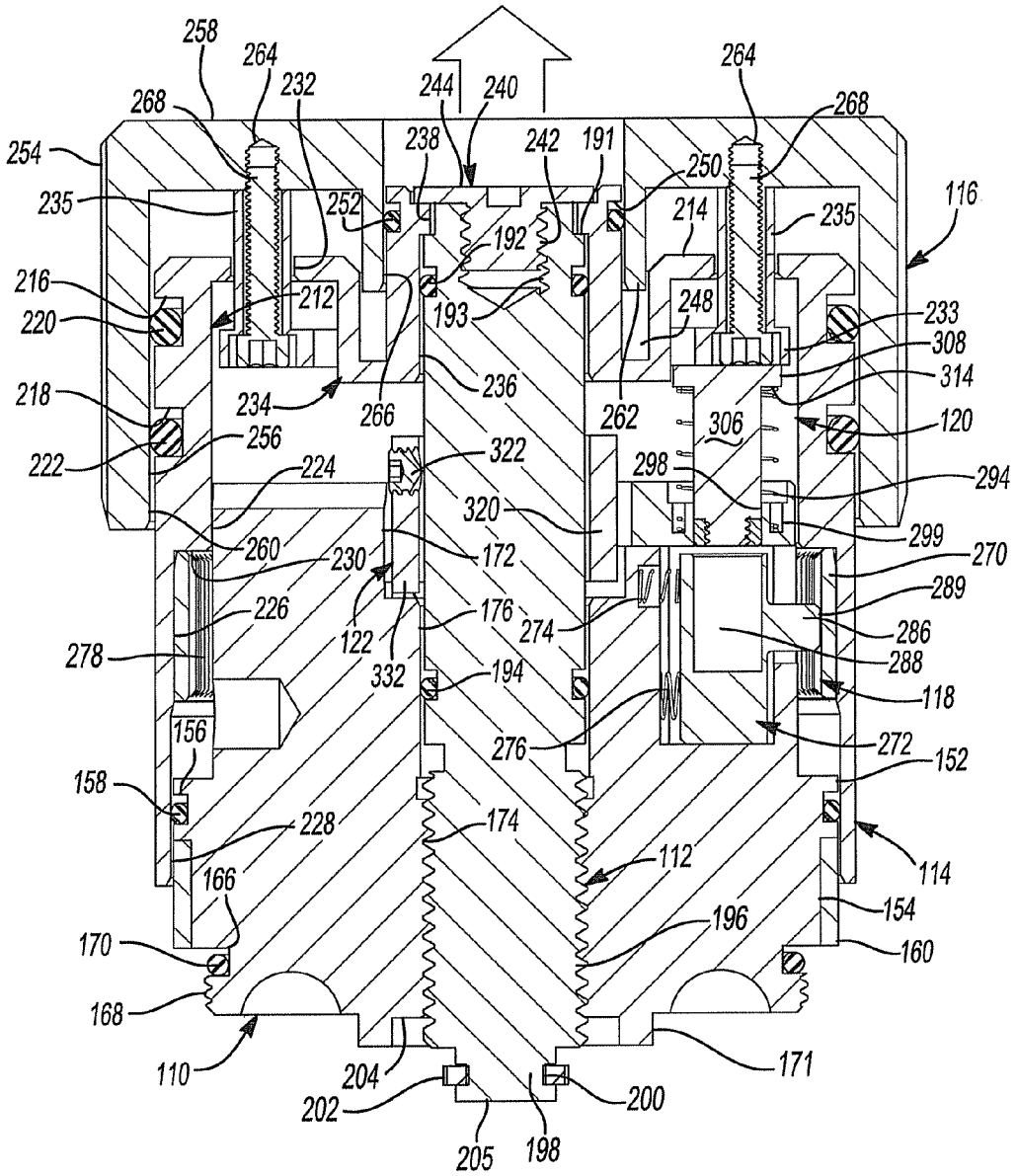
FIG. 9 is a cross-sectional view of the adjustment turret of FIG. 7 in an unlocked state.

Each of the threaded apertures 264 may be aligned with a corresponding one of the apertures 232 in the sleeve 114. Each of a plurality of threaded fasteners 268 may engage a corresponding one of the bushings 235 and a corresponding one of the threaded apertures 264. Distal ends 269 of the bushings 235 may abut an inner surface of the end portion 258. Because the bushings 235 slidably engage the apertures 232 in the sleeve 114 and the threaded fasteners 268, in turn, engage the bushings 235 and the threaded apertures 264, the cap 116 is rotationally fixed relative to the sleeve 114 and adjustment screw 112. As such, the cap 116 is axially movable relative to the sleeve 114 and adjustment screw 112 between a first position (FIG. 8) and a second position (FIG. 9).

The detent mechanism 118 may include a detent ring 270, a detent plunger 272, one or more first springs 274, and/or one or more second springs 276. The detent ring 270 may be fixed for rotation with the second portion 226 and the annular recess 230 of the inner diametrical surface 212 of the sleeve 114 via an adhesive bond, press-fit, and/or threaded fasteners for example. In some configurations, the detent ring 270 could be integrally formed with the inner diametrical surface 212 of the sleeve 114.

Figure 10:
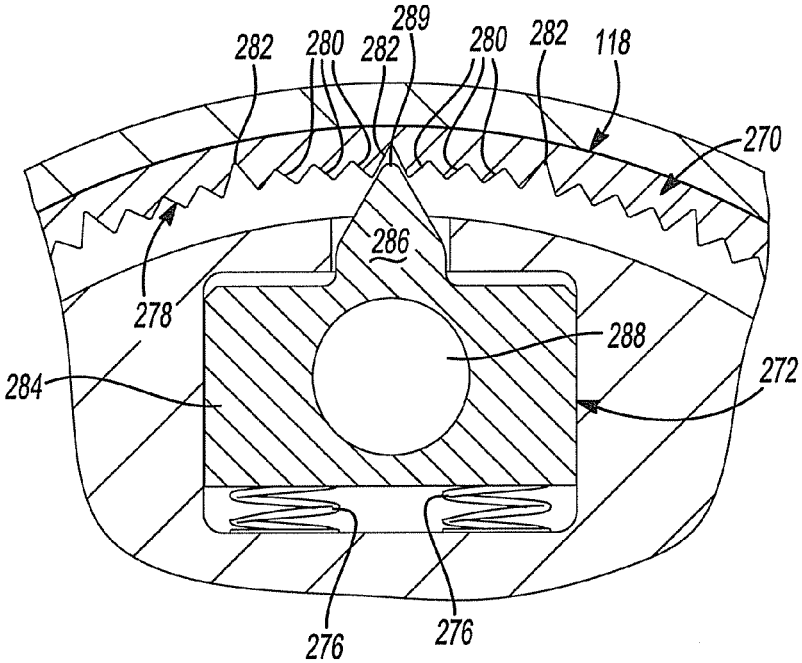
FIG. 10 is a partial cross-sectional view of a detent mechanism of the adjustment turret of FIG. 7.
Figure 11:
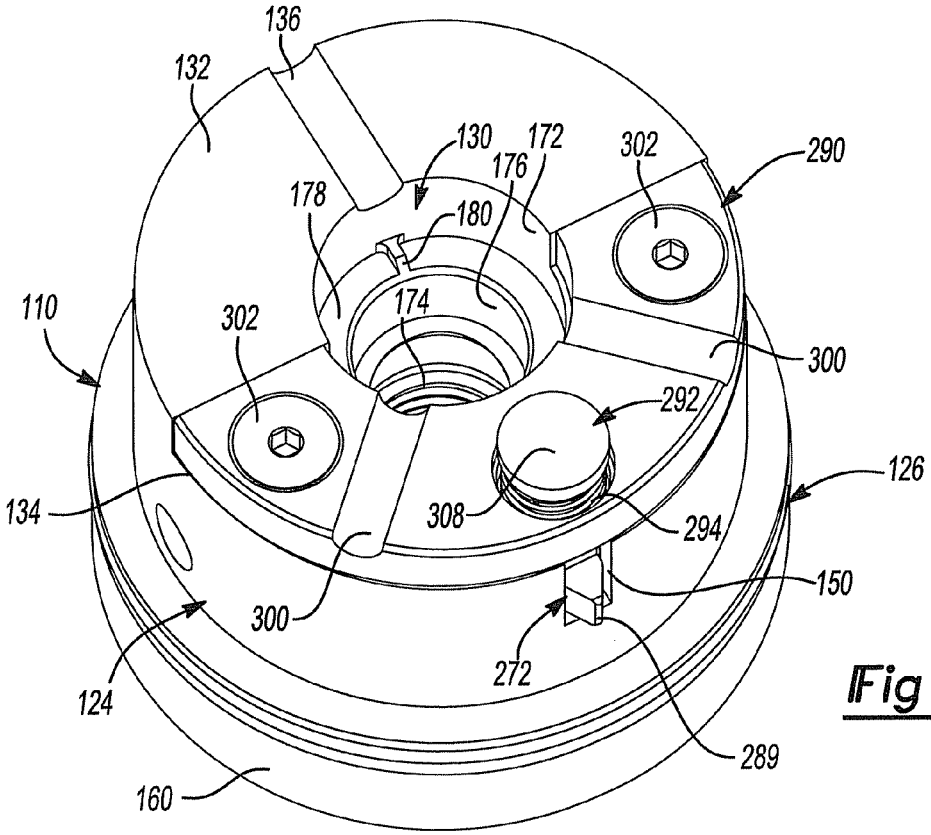
FIG. 11 is a perspective view of a body portion of the adjustment turret of FIG. 7 including a locking mechanism and the detent mechanism of FIG. 10 according to the principles of the present disclosure.
Figure 12:
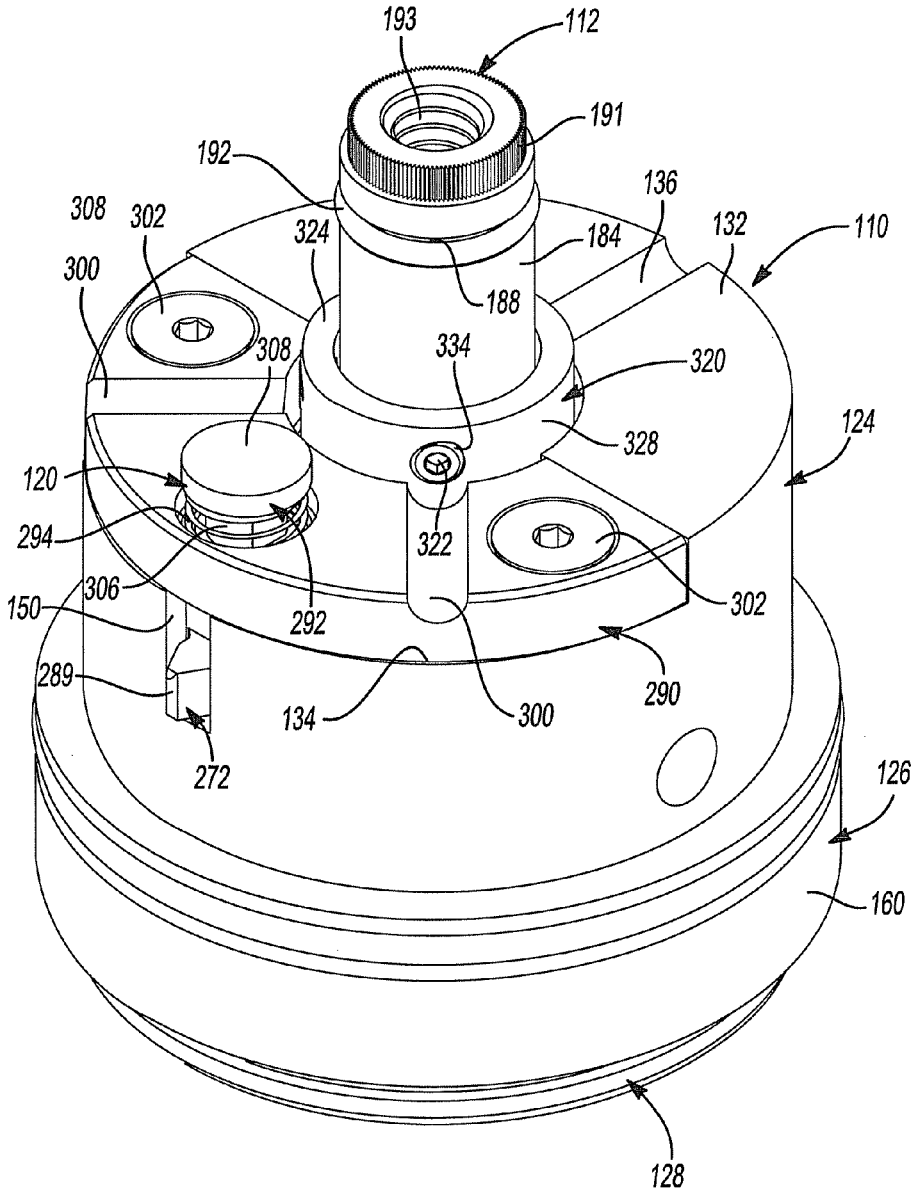
FIG. 12 is a perspective view of the body portion of FIG. 11 including an adjustment screw.
Figure 13:
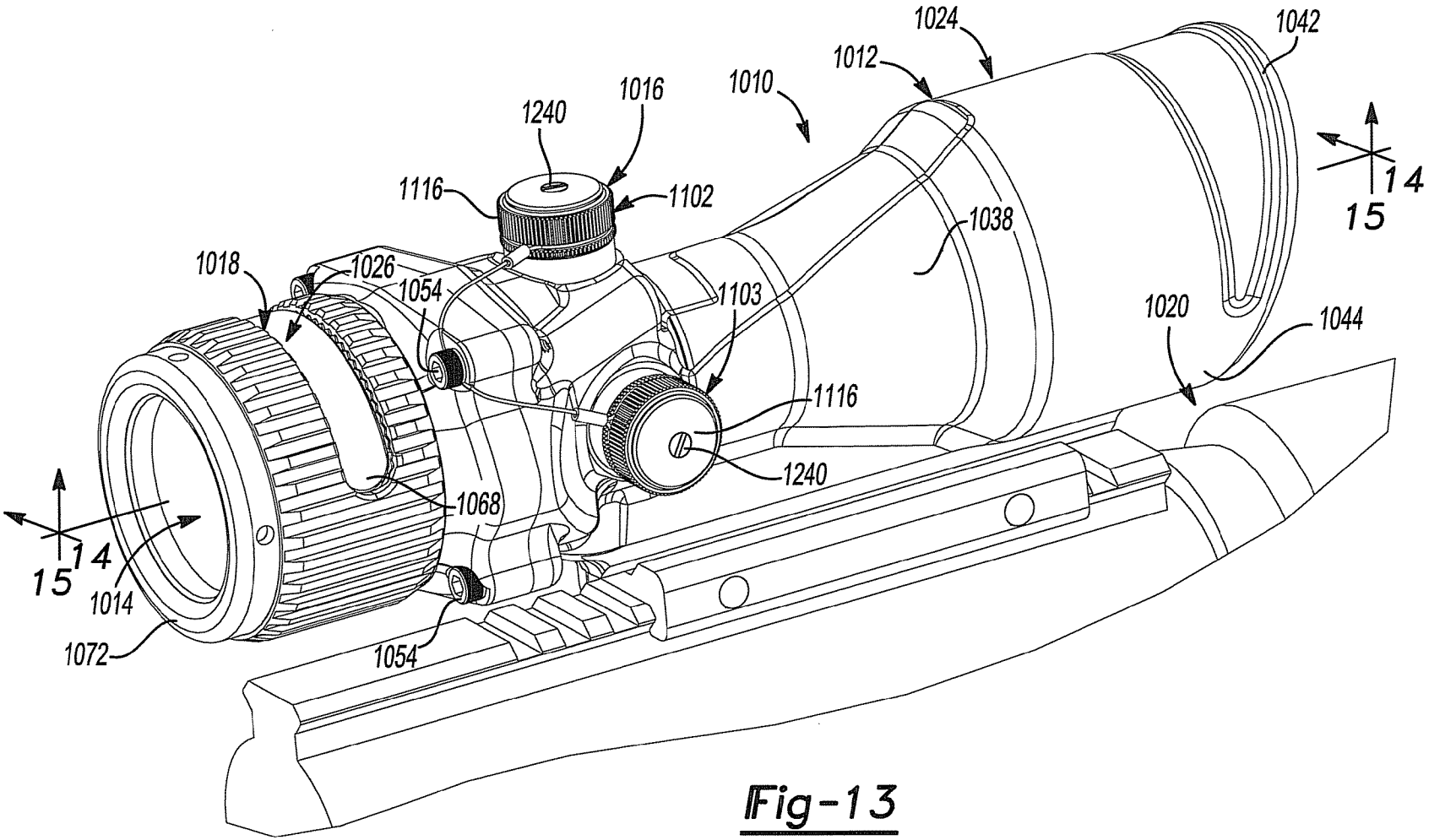
FIG. 13 is a perspective view of another optical sight according to the principles of the present disclosure.

A radially-inner surface 278 of the detent ring 270 may include a plurality of first detents 280 and a plurality of second detents 282 (FIG. 10). Each of the second detents 282 may be larger (i.e., deeper and wider) than each of the first detents 280. Each of the second detents 282 may be disposed between a pair or series of first detents 280. For example, each of the second detents 282 may be adjacent a series of three of the first detents 280. Stated another way, every fourth detent may be one of the second detents 282 (i.e., a three-to-one ratio of first detents 280 to second detents 282). It should be appreciated that a ratio of first detents 280 to second detents 282 may differ from that described above. For example, in some configurations, every fifth detent may be a second detent 282 or every tenth detent may be a second detent 282. In an exemplary configuration, each of the detents 280, 282 may be spaced apart from the immediately adjacent detent 280 or 282 by about one-tenth (0.1) of a milliradian and each of the second detents 282 may be spaced apart from the nearest other second detent 282 by about one milliradian.

The detent plunger 272 may include a body portion 284 having a plunger portion 286 protruding therefrom and a bore 288 disposed therein. The body portion 284 may be movably disposed within the cavity 142 in the body 110 such that the plunger portion 286 protrudes outwardly through the slot 150 communicating with the cavity 142. The bore 288 may extend substantially parallel to the axial bore 130 in the body 110.

The first and second springs 274, 276 may be disposed between the first surface 144 of the cavity 142 and the body portion 284 of the detent plunger 272. The first and second springs 274, 276 may cooperate to bias the detent plunger 272 toward the second surface 148 of the cavity 142 to bias a tip 289 of the plunger portion 286 into engagement with one of the first and second detents 280, 282. The first spring 274 may be partially received in the spring seat 146 in the cavity 142 to maintain a relative positioning of the first spring 274 and the detent plunger 272.

Relative movement between the detent plunger 272 and the detent ring 270 may cause the plunger portion 286 to sequentially engage and disengage individual ones of the detents 280, 282 as the individual ones of the detents 280, 282 move into and out of alignment with the plunger portion 286. Moving the detent ring 270 into a position relative to the plunger portion 286 such that the tip 289 of the plunger portion 286 is aligned with a space between directly adjacent first detents 280 or directly adjacent first and second detents 280, 282, causes the detent plunger 272 to be forced toward the first surface 144 of the cavity 142, against the biasing force of the first and second springs 274, 276. Further rotational movement of the detent ring 270 into a position relative to the plunger portion 286 such that the tip 289 of the plunger portion 286 is aligned with one of the first or second detents 280, 282 allows the first and second springs 274, 276 to urge the detent plunger 272 into engagement with the one of the first or second detents 280, 282.

Movement of the detent plunger 272 into engagement with one of the first or second detents 280, 282 may produce a tactile indication that the user can feel and/or an audible sound, such as a "clicking" sound, that the user can hear that indicates to the user that detent ring 270 has moved a predetermined distance relative to the detent plunger 272. Because of the size difference between the first and second detents 280, 282, movement of the detent plunger 272 into engagement with one of the first detents 280 may produce a first audible sound that is distinct from a second audible sound produced as a result of movement of the detent plunger 272 into engagement with one of the second detents 282. This audible difference aids a user when adjusting the sleeve 114 to allow a user to differentiate between a 0.1 milliradian adjustment and a one (1) milliradian adjustment by sound alone.

The locking mechanism 120 may include a bracket 290, a locking pin 292, and a biasing member 294. The bracket 290 may be a generally C-shaped member having a plurality of first apertures 296, a second aperture 298, an annular recess 299, and one or more access slots 300. The bracket 290 may be disposed on the recessed portion 134 of the body 110 such that the first apertures 296 may be aligned with a corresponding one of the threaded apertures 140. Each of a plurality of fasteners 302 may engage a corresponding one of the first apertures 296 and a corresponding one of the threaded apertures 140 to secure the bracket 290 to the body 110. The first apertures 296 may be countersunk or counterbored to receive heads 304 of the fasteners 302.

The second aperture 298 may be substantially coaxially aligned with the annular recess 299. When the tip 289 of the detent plunger 272 is engaged with one of the first and second detents 280, 282, the second aperture 298 may be substantially coaxially aligned with the bore 288 in the detent plunger 272.

The locking pin 292 may include a shaft portion 306 and a head portion 308. While the shaft portion 306 is shown in the figures including a threaded tip 310 engaging a nut 312, the shaft portion 306 could be a continuous, uniform-diameter shaft. The shaft portion 306 may be at least partially received in the second aperture 298 and is movable relative thereto between a first position (FIG. 8) and a second position (FIG. 9).

In the first position, the shaft portion 306 is partially received in the bore 288 to restrict movement of the detent plunger 272 into engagement with the detent ring 270. The biasing member 294 may be disposed around the shaft portion 306 of the locking pin 292 between a bottom surface 314 of the head portion 308 and the annular recess 299 in the bracket 290. The biasing member 294 may bias the locking pin 292 toward the second position and away from bore 288. The ring 233 may abut a top surface 316 of the head portion 308 such that axial movement of the cap 116 relative to the sleeve 114 causes the ring 233 to force the locking pin 292 downward into engagement with the bore 288 in the detent plunger 272. Because the locking pin 292 is only able to engage the bore 288 (i.e., move into the first position) when the tip 289 of the detent plunger 272 is engaged with one of the first or second detents 280, 282, movement of the locking pin 292 into the first position prevents relative rotation between the detent plunger 272 and the detent ring 270, thereby preventing relative rotation between the sleeve 114 and the body 110 and thus the adjustment screw 112 and the body 110.

The baseline-return mechanism 122 may include a collar 320 and one or more setscrews 322 or other fasteners. The collar 320 may be a generally tubular member having a first end 324, a second end 326, an outer surface 328, and an inner surface 330. The collar 320 may be disposed around the upper portion 184 of the adjustment screw 112 and may be at least partially received in the recessed portion 172 of the axial bore 130 such that the second end 326 faces the annular ledge 178. The second end 326 may include a protrusion or tab 332 extending downwardly (relative to the view shown in FIGS. 7-9) therefrom. A general size and shape of the tab 332 may be substantially similar to a general size and shape of the tab 180 in the axial bore 130 in the body 110. Furthermore, the tabs 180, 332 may be substantially radially equidistant to the axis defining the axial bore 130.

One or more threaded apertures 334 may extend radially through the outer and inner surfaces 328, 330. Spacing between adjacent threaded apertures 334 may correspond to spacing between adjacent access slots 300 in the bracket 290 and spacing between the access slots 300 and the access slot 136 in the body 110. The setscrews 322 may engage the threaded apertures 334. A user may threadably tighten the setscrews 322 against the upper portion 184 of the adjustment screw 112 to fix the collar 320 axially and rotationally relative to the adjustment screw 112. The user may selectively loosen the engagement between the setscrews 322 and the upper portion 184 to allow relative axial and rotational movement between the collar 320 and the adjustment screw 112.

Because the first adjuster assembly 102 may be substantially identical to the second adjuster assembly 103, a detailed description of the second adjuster assembly 103 is foregone.

With reference to FIGS. 1-12, operation of the adjustment system 16 will be described in detail. As described above, a user may operate the adjustment system 16 to adjust a position of the reticle-lens housing 88 and, thus, the reticle pattern 22 relative to a barrel of the firearm 20 to account for windage and elevation. The first adjuster assembly 102 and the biasing member 104 may cooperate to adjust a position of the reticle pattern 22 in a first dimension X (FIG. 4) to account for distance and elevation between the firearm 20 and the target. Likewise, the second adjuster assembly 103 and the biasing member 104 may cooperate to adjust a position of the reticle pattern 22 in a second dimension Y (FIG. 4) to account for windage. Because operation of the first adjuster assembly 102 may be substantially identical to operation of the second adjuster assembly 103, a detailed description of operation of the second adjuster assembly 103 is foregone.

Because the cap 116, sleeve 114 and adjustment screw 112 are rotationally fixed relative to each other, a user may rotate the cap 116 in a clockwise direction relative to the body 110 to cause corresponding clockwise rotation of the adjustment screw 112 relative to the body 110. Such clockwise rotation of the adjustment screw 112 may cause corresponding linear motion of the adjustment screw 112 relative to the body 110 downward (relative to the view shown in FIG. 4) in a first dimension X. The axial protrusion 198 transfers this motion to the zoom-lens housing 74 and moves the zoom-lens housing 74 downward (relative to the view shown in FIG. 4) in the first dimension X against the biasing force of the biasing member 104. Similarly, rotation of the cap 116 in a counterclockwise direction relative to the body 110 causes corresponding linear motion of the adjustment screw 112 upward (relative to the view shown in FIG. 4) in the first dimension X. The biasing member 104 biases the zoom-lens housing 74 toward the adjustment screw 112 to maintain contact therebetween and allow the zoom-lens housing 74 to move toward the first adjuster assembly 102 when the adjustment screw 112 moves away from the biasing member 104. Because the reticle pattern 22 is fixed relative to the zoom-lens housing 74, the user may rotate the cap 116 in either direction, as described above, to adjust the position of the reticle pattern 22 relative to the barrel of the firearm 20.

When the user rotates the cap 116, the corresponding relative rotation between the detent ring 270 and the detent plunger 272 causes the tactile indication and/or the audible "clicking" sound caused by sequential disengagement and engagement of the tip 289 of the detent plunger 272 with the first and second detents 280, 282, as described above. The spacing between each of the detents 280, 282 corresponds to a predetermined linear distance such that each tactile indication and/or "click" corresponds to adjustment of the reticle pattern 22 for a predetermined portion of a distance between the firearm 20 and the target.

Suppose, for example, that a distance between immediately adjacent first detents 280 and immediately adjacent first and second detents 280, 282 corresponds to a linear distance of one yard, and a distance between adjacent second detents 282 corresponds to a linear distance of ten yards. If a user desires to adjust the position of the reticle pattern 22 to account for a fifty-yard change in relative distance between the firearm 20 and the target, the user may rotate the cap 116 until the user counts fifty clicks. However, because the engagement between the detent plunger 272 and each of the first detents 280 produces a first clicking sound and/or a first tactile indication and engagement between the detent plunger 272 and each of the second detents 282 produces a second distinct clicking sound and/or a second distinct tactile indication, the user may simply rotate the cap 116 until the user hears five of the second clicks or feels five of the second tactile indications rather than counting fifty clicks or fifty tactile indications.

As described above, the cap 116 may be axially movable relative to the sleeve 114 between the first position (FIG. 8) and the second position (FIG. 9). Movement of the cap 116 between the first and second positions may cause corresponding movement of the locking mechanism 120 between a locked position and an unlocked position, respectively.

Because the cap 116 may be fixed relative to the ring 233, movement of the cap 116 downward relative to the sleeve 114 causes corresponding downward movement of the ring 233. Such downward movement of the ring 233 forces the locking pin 292 downward into engagement with the bore 288 in the detent plunger 272 against the biasing force of the biasing member 294. Such engagement between the locking pin 292 and the bore 288 prevents the detent plunger 272 from moving radially relative to the body 110, thereby locking the tip 289 of the detent plunger 272 into engagement with one of the first or second detents 280, 282. Because the detent plunger 272 is prevented from disengaging the particular detent 280, 282 with which it is aligned when the cap 116 is in the first position, the detent ring 270 is prevented from moving rotationally relative to the detent plunger 272. Because the detent ring 270 is rotationally fixed relative to the sleeve 114, which in turn is rotationally fixed relative to the adjustment screw 112, movement of the locking mechanism 120 into the locked position prevents the cap 116 from being rotated. Therefore, when the locking mechanism 120 is in the locked position, the first adjuster assembly 102 may be prevented from moving the zoom-lens housing 74 (and thus the reticle-lens housing 88 and the reticle pattern 22) relative to the barrel of the firearm 20. Friction between the first and second sealing members 220, 222 and the inner surface 256 of the cap 116 may retain the cap 116 in the first position. While in some embodiments, the friction between the first and second sealing members 220, 222 and the inner surface 256 may be sufficient to retain the cap 116 in the first position, in other embodiments, the inner surface 256 and/or the outer diametrical surface 210 of the sleeve 114 may include one or more detents, ribs and/or other features to increase friction therebetween to selectively retain the cap 116 in the first position.

Movement of the cap 116 upward into the second position may cause corresponding upward movement of the ring 233 away from the detent mechanism 118 allowing the biasing member 294 to bias the locking pin 292 upward and out of engagement with the bore 288 in the detent plunger 272. The biasing force of the biasing member 294 and friction between the first and second sealing members 220, 222 and the inner surface 256 of the cap 116 may cooperate to retain the cap 116 in the second position. When the cap 116 is in the second position (i.e., the locking mechanism 120 is in the unlocked position), the user may adjust the position of the reticle pattern 22 by rotating the cap 116 relative to the body 110, as described above.

A user may "sight-in" the optical sight 10 by calibrating the position of the reticle pattern 22 relative to the barrel of the firearm 20. The user may choose to sight-in the optical sight 10 by calibrating the optical sight 10 to be on-target when the firearm 20 is a predetermined distance from the target, such as two hundred yards, for example. While the user is in the process of sighting-in the optical sight 10, the user may loosen the setscrews 322 of the baseline-return mechanism 122 relative to the adjustment screw 112 so that the adjustment screw 112 is free to rotate independently from the collar 320. When the optical sight 10 is sighted-in at the predetermined distance, the user may choose to designate the then-current position of the adjustment screw 112 as a baseline position. To do so, the user may first rotate the collar 320 relative to the body 110 until the tab 332 on the collar 320 abuts the tab 180 in the axial bore 130. Then, the user may tighten the setscrews 322 against the adjustment screw 112 to fix the collar 320 relative to the adjustment screw 112. In this manner, the tabs 180, 332 may cooperate with each other to act as a positive stop at the user's chosen baseline position, as the interference between the tabs 180, 332 prevents further clockwise rotation of the adjustment screw 112 and corresponding downward movement of the zoom-lens housing 74. Therefore, if the user subsequently actuates the first adjuster assembly 102 to account for a greater distance between the target and the firearm 20 than the predetermined distance (i.e., by rotating the cap 116 counterclockwise), the user may quickly return to the baseline position by rotating the cap 116 clockwise until the tabs 180, 332 abut each other.

Once the user sights-in the optical sight 10, the user may remove the fastener 240 and subsequently remove the sleeve 114 and the cap 116 from the body 110. The user may then install the sleeve 114 and the cap 116 back onto the body 110 so that markings on the sleeve 114 and/or the cap 116 are aligned with corresponding indicia 162 on the indicator ring 160. The user may then reinstall the fastener 240 to secure the sleeve 114 and cap 116 to the adjustment screw 112.

With reference to FIGS. 13-16, an optical sight 1010 is provided and may include a housing 1012, an optics train 1014, an adjustment system 1016, and an illumination system 1018. The housing 1012 may be selectively attached to a firearm 1020 and supports the optics train 1014, adjustment system 1016, and illumination system 1018. The optics train 1014 cooperates with the housing 1012 to provide a magnified image of a target while the adjustment system 1016 positions the optics train 1014 relative to the housing 1012 to properly align the optics train 1014 relative to the firearm 1020. In one configuration, the optics train 1014 magnifies a target to a size substantially equal to six times the viewed size of the target (i.e., 6× magnification). The illumination system 1018 cooperates with the optics train 1014 to illuminate a reticle pattern (which may be similar to the reticle pattern 22 shown in FIG. 6 to assist in aligning the target relative to the optical sight 1010 and firearm 1020.

The housing 1012 includes a main body 1024 attached to an eyepiece 1026. The main body 1024 may include a series of threaded bores 1028 for use in attaching the housing 1012 to the firearm 1020 and an inner cavity 1030 having a longitudinal axis 1032. A first end 1034 of the main body 1024 may include a substantially circular shape and is in communication with the inner cavity 1030 of the housing 1012. A second end 1036 is disposed generally on an opposite side of the main body 1024 from the first end 1034 and similarly includes a generally circular cross section. A tapered bore portion 1038 is disposed between the first end 1034 and second end 1036 and includes a stepped surface 1040 that defines a profile of the tapered bore portion 1038.

The first end 1034 of the main body 1024 includes an entrance pupil having a larger diameter than an exit pupil of the second end 1036. The entrance pupil of the first end 1034 defines how much light enters the optical sight 1010 and cooperates with the exit pupil to provide the optical sight 1010 with a desired magnification. In one configuration, the entrance pupil includes a diameter that is substantially six times larger than a diameter of the exit pupil. Such a configuration provides the optical sight 1010 with a "6× magnification." While the exit pupil is described as being six times smaller than the entrance pupil, the exit pupil may be increased to facilitate alignment of a user's eye with the optical sight 1010. The first end 1034 may include a truncated portion 1042 that extends toward a target a greater distance than a bottom portion 1044 to prevent ambient light from causing a glare on the optics train 1014.

Figure 16:
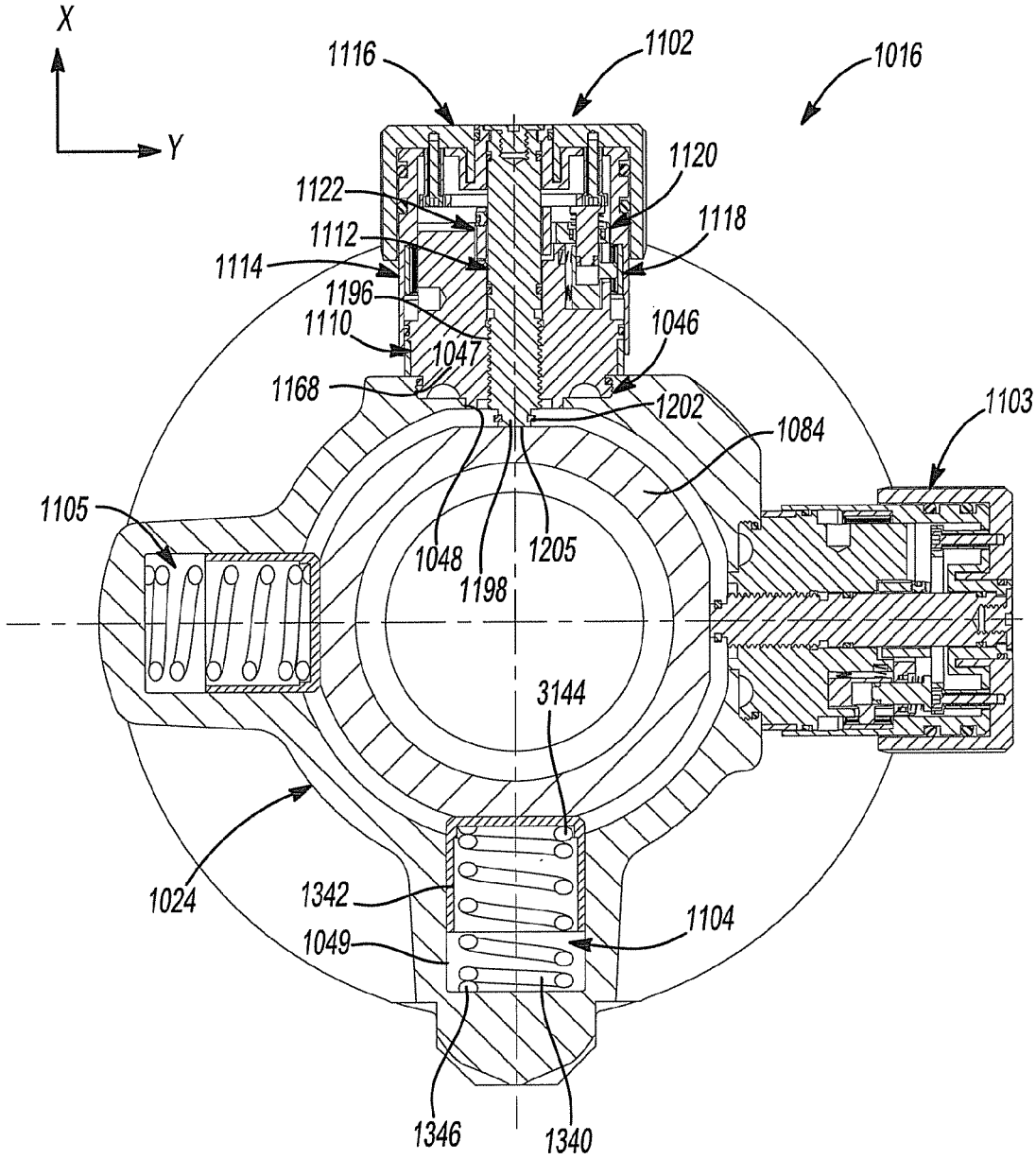
FIG. 16 is a cross-sectional view of another adjustment system according to the principles of the present disclosure.

The main body 1024 supports the adjustment system 1016 and may include at least one bore 1046 and at least one cavity 1049 that receive portions of the adjustment system 1016 therein. As shown in FIG. 16, each of the bores 1046 may include a threaded portion 1047 and a generally substantially cylindrical portion 1048. Each of the cavities 1049 may be substantially coaxial with and disposed substantially one hundred eighty (180) degrees apart from a corresponding one of the bores 1046.

The main body 1024 may include a locking feature 1050 that cooperates with the eyepiece 1026 to position the main body 1024 relative to the eyepiece 1026 and attach the main body 1024 to the eyepiece 1026. The locking feature 1050 may include a tab 1052 extending from the main body 1024 for interaction with the eyepiece 1026. An annular seal 1053 may be disposed between the main body 1024 and the eyepiece 1026 for providing a seal between the main body 1024 and eyepiece 1026. While the main body 1024 is described as including a locking feature 1050 having a tab 1052 and an annular seal 1053, the main body 1024 could additionally or alternatively include any locking feature that attaches the main body 1024 to the eyepiece 1026. For example, the locking feature 1050 could include a series of fasteners 1054 (FIG. 13) that are received through the eyepiece 1026 and inserted into the main body 1024 to position the eyepiece 1026 relative to the main body 1024 and to attach the eyepiece 1026 to the main body 1024. If fasteners 1054 are used to attach the eyepiece 1026 to the main body 1024, the main body 1024 may include a series of threaded bores (not shown) that matingly receive the fasteners 1054. While the main body 1024 and eyepiece 1026 are described and shown as being separate components, the main body 1024 could be integrally formed with the eyepiece 1026, thereby obviating the need for additional seals and fasteners. Alternatively, the eyepiece 1026 may similarly include threaded bores (not shown) that matingly receive the fasteners 1054.

The eyepiece 1026 includes a longitudinal axis 1060 that is co-axially aligned with the longitudinal axis 1032 of the main body 1024 when the eyepiece 1026 is assembled to the main body 1024. The eyepiece 1026 includes a first end 1062 attached to the main body 1024 via the locking feature 1050 and a second end 1064 disposed on an opposite end of the eyepiece 1026 from the first end 1062. The first end 1062 may include an inner arcuate surface 1066 that is aligned with an inner arcuate surface 1067 of the main body 1024 when the eyepiece 1026 is attached to the main body 1024. The inner arcuate surface 1066 cooperates with the inner arcuate surface 1067 of the main body 1024 to create a spherical seat, which permits movement of a portion of the optics train 1014 relative to the housing 1012 during adjustment of the optics train 1014. As will be described further below, movement of a portion of the optics train 1014 relative to the housing 1012 provides for adjustment for the reticle pattern relative to the housing 1012 and, thus, alignment of the optical sight 1010 relative to the firearm 1020. A retainer ring 1072 may be positioned at a distal end of the eyepiece 1026, adjacent to the illumination system 1018, and may be used to retain an adjustment mechanism such as, for example, a rotary dial of the illumination system 1018. The first end 1062 may also include a recess 1068 that receives at least a portion of the illumination system 1018.

Figure 14:
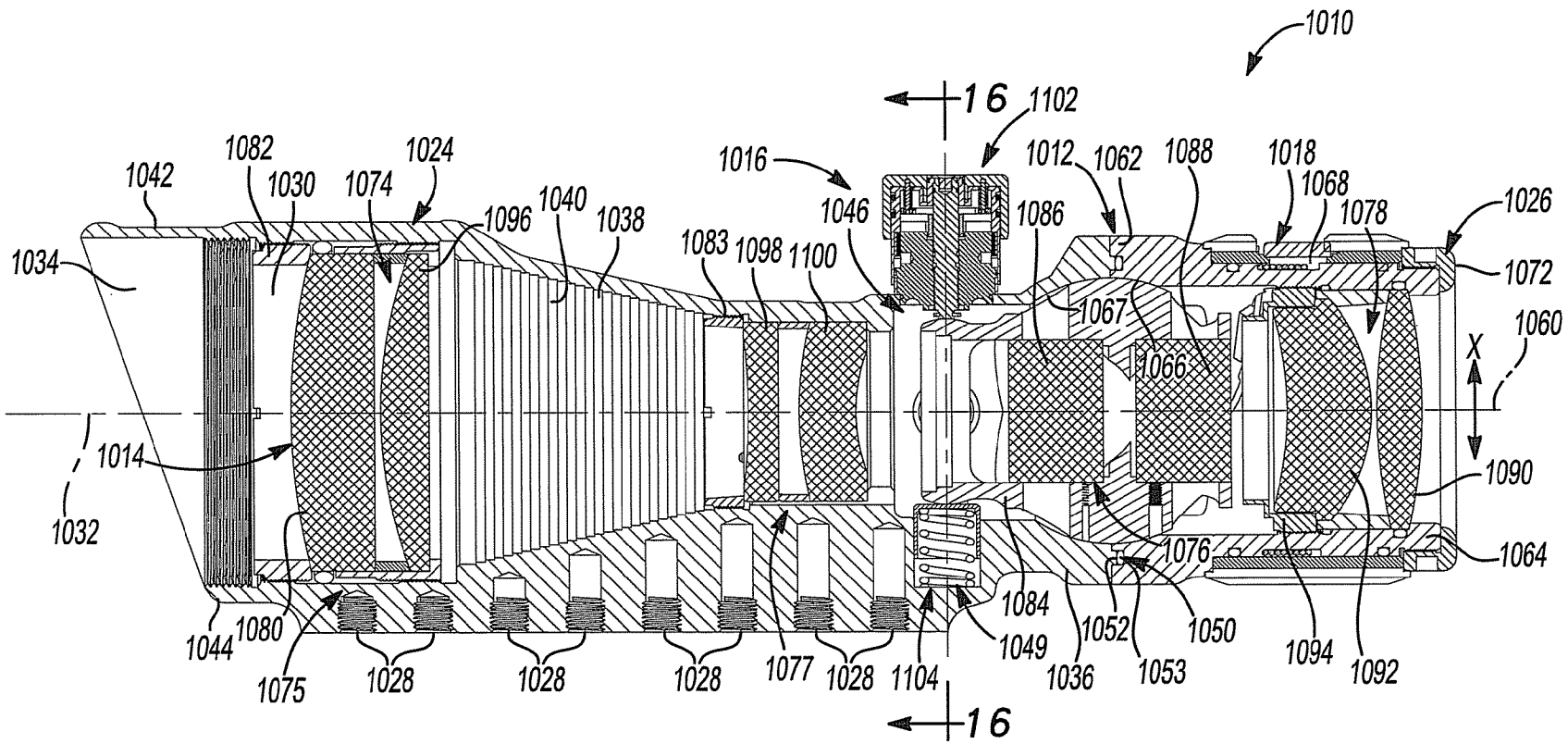
FIG. 14 is a cross-sectional view of the optical sight of FIG. 13 taken along line 14-14.
Figure 15:
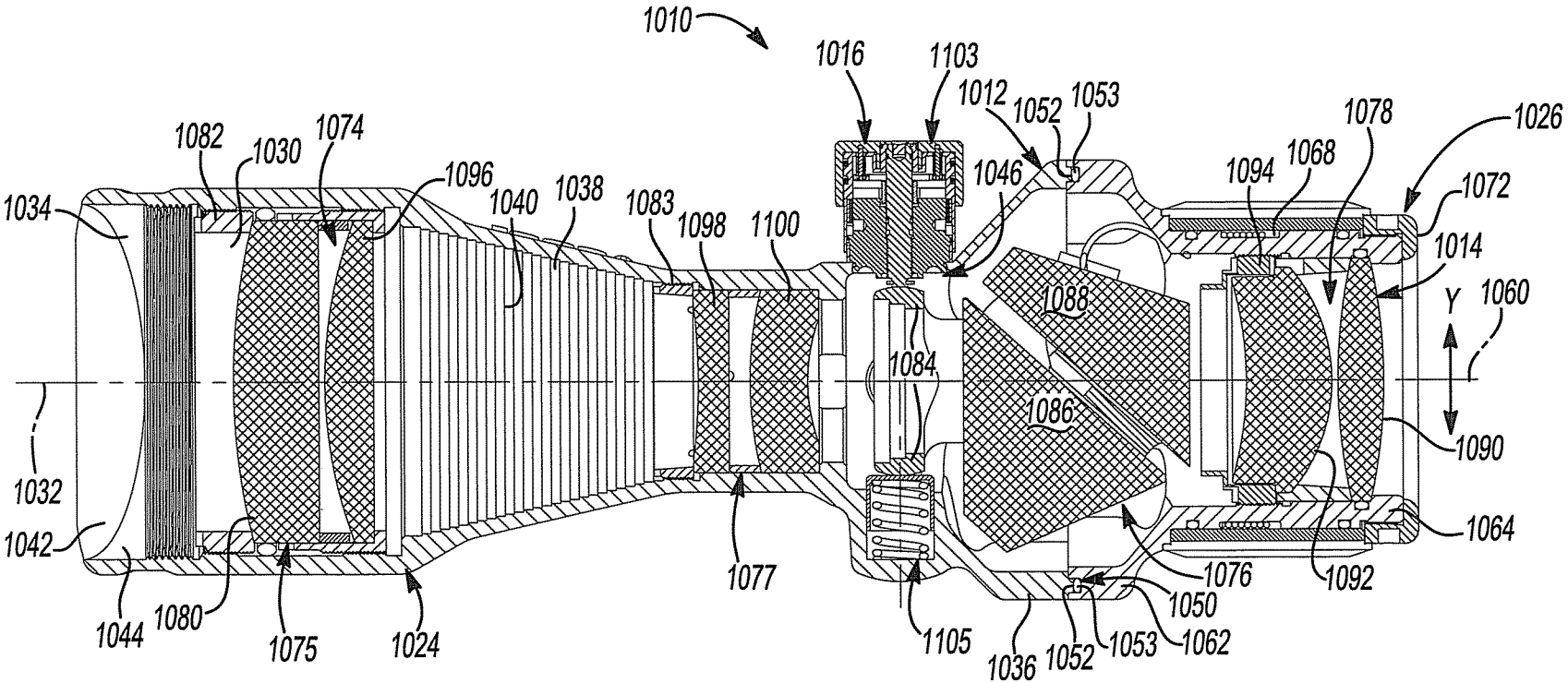
FIG. 15 is a cross-sectional view of the optical sight of FIG. 13 taken along line 15-15.

With particular reference to FIGS. 14 and 15, the optics train 1014 is shown to include an objective-lens system 1074, an image-erector system 1076, and an ocular-lens system 1078. The objective-lens system 1074 may be a telephoto objective and may include a front positive power group 1075 and a rear-negative-power group 1077. The front-positive-power group 1075 may be disposed generally proximate to the first end 1034 of the main body 1024 and may include a convex-plano doublet lens 1080 having a substantially doublet-convex lens and a substantially concave-convex lens secured together by a suitable adhesive and a convex-plano singlet lens 1096. The lenses 1080, 1096 may be secured within the first end 1034 of the main body 1024 via a threaded retainer ring 1082 and/or adhesive to position and attach the lenses 1080, 1096 relative to the main body 1024 of the housing 1012.

The rear-negative-power group 1077 is disposed generally between the front-positive-power group 1075 and the second end 1036 of the main body 1024 and may include a concave-plano singlet lens 1098 and a convex-concave doublet lens 1100. As with the front-positive-power group 1075, the singlet lens 1098 and doublet lens 1100 of the rear-negative-power group 1077 may be retained and positioned within the main body 1024 of the housing 1012 via a threaded retainer 1083 and/or an adhesive.

The image-erector system 1076 is disposed within the housing 1012 generally between the objective-lens system 1074 and the ocular-lens system 1078. The image erector system 1076 may include a housing 1084, a roof prism 1086, and a mirror prism 1088, which cooperate to form a Pechan prism assembly. The image-erector system 1076 cooperates with the objective-lens system 1074 and ocular-lens system 1078 to properly orient an image of a sighted target relative to the housing 1012 and, thus, the firearm 1020. For example, when an image is received at the first end 1034 of the main body 1024, the image travels along the longitudinal axis 1032 of the main body 1024 and travels along a light path of the Pechan prism assembly prior to being viewed at the eyepiece 1026. The image-erector system 1076 may also cooperate with the illumination system 1018 to provide the overall shape and size of the reticle pattern displayed at an eyepiece lens 1090.

The image from the image-erector system 1076 is received by the ocular-lens system 1078 disposed proximate to the eyepiece 1026. The ocular-lens system 1078 is disposed generally on an opposite end of the optical sight 1010 from the objective-lens system 1074 and may include the eyepiece lens 1090, which may be of a bi-convex singlet or substantially doublet-convex type lens, and a doublet-ocular lens 1092. Hereinafter, the eyepiece lens 1090 will be described as doublet-convex eyepiece lens 1090. The doublet-ocular lens 1092 may include a substantially doublet-convex lens and a substantially doublet-concave lens secured together by a suitable adhesive. The doublet-convex eyepiece lens 1090 and doublet-ocular lens 1092 may be held in a desired position relative to the eyepiece 1026 of the housing 1012 via a threaded retainer ring 1094. While threaded retainer ring 1094 is disclosed, the doublet-convex eyepiece lens 1090 and doublet-ocular lens 1092 could alternatively and/or additionally be attached to the eyepiece 1026 of the housing 1012 using an adhesive.

The optical sight 1010 may provide a magnification of a target of approximately six times (i.e., 6× magnification) the size of the viewed target (i.e., the target as viewed without using the optical sight 1010). Increasing the ability of the optical sight 1010 to magnify an image of a target improves the ability of the optical sight 1010 in enlarging distant targets and allows the optical sight 1010 to enlarge targets at greater distances. Generally speaking, such improvements in magnification can be achieved by introducing an objective lens having a longer focal length. However, increasing the length of the objective lens focal length increases the overall length of the housing 1012 and therefore also increases the overall length and size of the optical sight 1010.

As described above, a 6× magnification is achieved by increasing the objective lens focal length through use of multiple lenses. Cooperation between the convex-plano singlet lens 1096, concave-plano singlet lens 1098, and doublet lens 1100 with the objective-lens system 1074, image-erector system 1076, and ocular-lens system 1078 provides the optical sight 1010 with the ability to magnify a target six times greater than the viewed size of the target. Specifically, adding lenses 1096, 1098, and 1100 to the front-positive-power group 1075 and a rear-negative-power group 1077, respectively, allows the optical sight 1010 to have a 6× magnification without requiring a lengthy and cumbersome housing.

It should be appreciated that the above description of the optics train 1014 is provided to illustrate an exemplary configuration of optical components. The principles of the present disclosure are not limited in application to an optical sight having an optics train including the particular components and/or arrangement of components described above. The optical sight 1010 may include any other configuration or arrangement of optical components to suit a given application and may provide the optical sight 1010 with virtually any magnification.

The adjustment system 1016 may include the first and second adjuster assemblies or turrets 1102, 1103 and first and second biasing assemblies 1104, 1105. The first and second adjuster assemblies 1102, 1103 may be substantially similar in structure and function as the first and second adjuster assemblies 102, 103 described above, and therefore, will not be described again in detail. The first adjuster assembly 1102 may cooperate with the first biasing assembly 1104 to move the housing 1084 of the image-erector system 1076 relative to the housing 1012 along an axis X that is substantially perpendicular to the axes 1032, 1060. The second adjuster assembly 1103 cooperates with the second biasing assembly 1105 to move the housing 1084 of the image erector system 1076 relative to the housing 1012 along an axis Y that is substantially perpendicular to axis X and is substantially perpendicular to axes 1032, 1060. Movement of the housing 1084 of the image-erector system 1076 relative to the housing 1012 similarly moves the roof prism 1086 and mirror prism 1088 relative to the housing 1012 and therefore adjusts a position of the reticle pattern relative to the housing 1012. Such adjustments of the reticle pattern relative to the housing 1012 may be used to align the reticle pattern relative to the firearm 1020 to account for elevation (i.e., along axis X) and windage (i.e., along axis Y).

The first biasing assembly 1104 may be at least partially received in the cavity 1049 of the housing 1012 disposed one-hundred-eighty degrees (180°) apart from the first adjuster assembly 1102. The first biasing assembly 1104 may include a biasing member 1340 and a generally cup-shaped bushing 1342. The biasing member 1340 may be a helical compression spring, for example, and may include a first end 1344 seated against the bushing 1342 and a second end 1346 seated against the cavity 1049. The biasing member 1340 may bias the housing 1084 of the image-erector system 1076 toward the first adjuster assembly 1102.

Because the first adjuster assembly 1102 may be substantially identical to the second adjuster assembly 1103 and the first biasing assembly 1104 may be substantially identical to the second biasing assembly 1105, detailed descriptions of the second adjuster assembly 1103 and second biasing assembly 1105 are foregone.

With continued reference to FIGS. 13-16, operation of the adjustment system 1016 will be described in detail. As described above, a user may operate the adjustment system 1016 to adjust a position of the housing 1084 and, thus, the reticle pattern relative to a barrel of the firearm 1020 to account for windage and elevation. The first adjuster assembly 1102 and the first biasing assembly 1104 may cooperate to adjust a position of the reticle pattern in the first dimension X to account for distance and elevation between the firearm and the target. The second adjuster assembly 1103 and second biasing assembly 1105 may cooperate to adjust a position of the reticle pattern in the second dimension Y to account for windage. Because operation of the first adjuster assembly 1102 and first biasing assembly 1104 may be substantially identical to operation of the second adjuster assembly 1103 and second biasing assembly 1105, a detailed description of operation of the second adjuster assembly 1103 and second biasing assembly 1105 is foregone.

While the optical sights 10, 1010 are described above as being mounted to the firearms 20, 1020, respectively, the optical sights 10, 1010 are not limited in application to firearms. For example, either of the optical sights 10, 1010 may be mounted to an archery bow, a crossbow, or other weapon. Furthermore, the first and second adjuster assemblies 102, 1102, 103, 1103 are not limited in application to the optical sights 10, 1010 described above. The first and/or second adjuster assemblies 102, 1102, 103, 1103 could be incorporated into a sight or other aiming device that includes different and/or additional optical components or a sight or aiming device that lacks optical components for magnifying or otherwise manipulating an image, such as an "open-sight" or "iron-sight" aiming system, for example.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An adjustment turret for an optical sight, the adjustment turret comprising:

a body including an axial threaded bore extending therethrough, said body further including a cavity;

an adjustment shaft threadably engaging said axial threaded bore for relative rotation therebetween;

a cap connected to said adjustment shaft for rotation with said adjustment shaft relative to said body and at least partially receiving said adjustment shaft, said cap being axially movable relative to said body and said adjustment shaft between a first position and a second position; and a locking pin axially movable with said cap when said cap is moved between said first position and said second position, said locking pin being received in said cavity when said cap is in said first position to prevent relative rotation between said cap and said body and removed from said cavity when said cap is in said second position to allow relative rotation between said cap and said body.

2. The adjustment turret of claim 1, further comprising a detent plunger slidably disposed within said cavity, said locking pin engaging said detent plunger when said cap is in said first position to restrict movement of said detent plunger within said cavity.

3. The adjustment turret of claim 2, wherein restricting movement of said detent plunger within said cavity prevents relative rotation between said cap and said body.

4. The adjustment turret of claim 2, wherein restricting movement of said detent plunger within said cavity prevents removal of said detent plunger from a detent associated with said cap to prevent relative rotation between said cap and said body.

5. The adjustment turret of claim 1, further comprising a sleeve rotationally fixed relative to said adjustment shaft and said cap for rotation with said adjustment shaft and said cap relative to said body.

6. The adjustment turret of claim 5, wherein said sleeve includes a central hub having a first aperture extending axially therethrough, said first aperture engaging a first end of said adjustment shaft.

7. The adjustment turret of claim 6, wherein said cap includes a second aperture slidably engaging said central hub.

8. The adjustment turret of claim 7, further comprising a fastener threadably engaging said first end of said adjustment shaft and fixing said adjustment shaft relative to sleeve.

9. The adjustment turret of claim 5, wherein said sleeve includes a detent ring disposed around said body, said detent ring including a plurality of first detents.

10. The adjustment turret of claim 9, wherein said detent ring includes a plurality of second detents that are larger than said first detents, each of said second detents being disposed directly adjacent to two of said first detents.

11. The adjustment turret of claim 9, further comprising a detent plunger including a body portion disposed in said cavity and a plunger portion protruding from said body portion and selectively engaging one of said plurality of detents.

12. The adjustment turret of claim 11, further comprising at least one biasing member biasing said detent plunger radially outward and into engagement with said detent ring.

13. The adjustment turret of claim 11, wherein movement of said detent plunger into engagement with one of said first detents generates a first sensory perceptible indicator and movement of said detent plunger into engagement with one of said second detents generates a second sensory perceptible indicator that is distinguishable from said first sensory perceptible indicator.

14. The adjustment turret of claim 11, wherein said body portion of said detent plunger includes a bore slidably receiving said locking pin in said first position.

15. The adjustment turret of claim 1, wherein said locking pin includes a head portion and a shaft portion.

16. The adjustment turret of claim 15, further comprising a spring disposed around said shaft portion between said head portion and said body and urging said cap toward said second position.

17. The adjustment turret of claim 1, further comprising a stop ring fixed for rotation with said adjustment shaft and including a first stop tab selectively engaging a second stop tab disposed on said body, wherein engagement between said first and second stop tabs limits axial travel of said adjustment shaft in a first direction.

18. The adjustment turret of claim 1, wherein movement of said adjustment shaft causes corresponding movement of a reticle of the optical sight.

19. An adjustment turret for an optical sight, the adjustment turret comprising:

a body including a first stop tab and an axial threaded bore extending through said body;

an adjustment shaft threadably engaging said axial threaded bore for relative rotation therebetween;

a cap connected to said adjustment shaft for rotation with said adjustment shaft relative to said body; and a stop ring including a second stop tab selectively interfering with said first stop tab to limit rotation of said adjustment shaft in a first direction.

20. The adjustment turret of claim 19, wherein said body includes a recess disposed axially adjacent to said axial threaded bore, said first stop tab being disposed within said recess.

21. The adjustment turret of claim 20, wherein said stop ring is selectively received within said recess.

22. The adjustment turret of claim 19, wherein said stop ring includes an engagement member movable between a first position engaging said adjustment shaft to fix said stop ring relative to said adjustment shaft and a second position disengaging said stop ring and said adjustment shaft, said first and second stop tabs limiting rotation of said adjustment shaft in said first direction when said engagement member is in said first position.

23. The adjustment turret of claim 22, wherein said body includes a radial bore providing access to said engagement member.

24. The adjustment turret of claim 22, wherein said engagement member includes a set screw.

25. The adjustment turret of claim 19, further comprising a locking pin axially movable with said cap between a first position and a second position, said locking pin received within a cavity of said body in said first position to prevent relative rotation between said cap and said body and removed from said cavity in said second position to permit relative rotation between said cap and said body.

26. The adjustment turret of claim 25, further comprising a detent plunger slidably disposed within said cavity, said locking pin engaging said detent plunger when said cap is in said first position to restrict movement of said detent plunger within said cavity.

27. The adjustment turret of claim 26, wherein restricting movement of said detent plunger within said cavity prevents relative rotation between said cap and said body.

28. The adjustment turret of claim 26, wherein restricting movement of said detent plunger within said cavity prevents removal of said detent plunger from a detent associated with said cap to prevent relative rotation between said cap and said body.

* * * * *